United States Patent [19]

Gysel et al.

[11] 4,285,725

[45] Aug. 25, 1981

[54] NON-MAGNETIZABLE STEEL CASTING ALLOY, ITS USE AND PROCESS OF MANUFACTURE

[75] Inventors: Walter Gysel, Schaffhausen, Switzerland; Adolf Trautwein, Gottmadingen, Fed. Rep. of Germany

[73] Assignee: Georg Fischer Aktiengesellschaft, Schaffhausen, Switzerland

[21] Appl. No.: 118,805

[22] PCT Filed: Nov. 24, 1978

[86] PCT No.: PCT/CH78/00040

§ 371 Date: Jul. 30, 1979

§ 102(e) Date: Jul. 23, 1979

[87] PCT Pub. No.: WO79/00328

PCT Pub. Date: Jun. 14, 1979

[30] Foreign Application Priority Data

Nov. 30, 1977 [CH] Switzerland ..... 14647/77
Jan. 24, 1978 [CH] Switzerland ..... 726/78

[51] Int. Cl.[3] ..... C22C 39/20

[52] U.S. Cl. ..... 75/128 A; 75/128 C; 148/129

[58] Field of Search ..... 75/128 A, 128 C, 128 J; 148/13.1, 129

[56] References Cited

U.S. PATENT DOCUMENTS 3,081,164 3/1963 Schram ..... 75/123
3,162,555 12/1964 Barth ..... 148/145
3,574,605 4/1971 Hall et al. ..... 75/128
3,645,725 2/1972 Denhard, Jr. et al. ..... 75/128 A
3,854,938 12/1974 Baybrook et al. ..... 75/128

*Primary Examiner*—Upendra Roy
*Attorney, Agent, or Firm*—Toren, McGeady and Stanger

[57] ABSTRACT

A non-magnetizable steel casting alloy with the composition

| | |
|---|---|
| C | max. 0.30% |
| Si | max. 2.00% |
| Mn | 4.00–20.00% |
| Cr | 10.00–20.00% |
| Ni | 4.00–12.00% |
| Mo | max. 3.00% |
| $N_2$ | 0.02–0.20% |

the remainder being iron, and with a magnetic permeability $\mu \leqq 1.20$ and with a CrNiMn equivalence factor: $f = 6.5 - \%\ Cr - 0.4 \cdot \%\ Ni + 0.1 \cdot \%\ Mn + 0.075 \cdot \%\ Cr \cdot \%\ Ni + 0.013 \cdot \%\ Cr \cdot \%\ Mn - 0.02 \cdot \%\ Ni \cdot \%\ Mn$, wherein $-6 \leqq f \leqq +2$, meets in the best manner the total set of the following properties: deep permeability, homogeneous strength and toughness values, structural stability at low temperatures, homogeneous magnetic permeability in large solidification cross sections, good machinability and weldability without micro-cracks, and a sufficient yield point.

Furthermore, uses in high field intensities and low temperatures and a process in which a heat treatment takes place after welding are subject matter of the invention.

4 Claims, 5 Drawing Figures

NON-MAGNETIZABLE STEEL CASTING ALLOY, ITS USE AND PROCESS OF MANUFACTURE

BACKGROUND OF THE INVENTION

1. Field of the Invention

The invention relates to a non-magnetizable steel casting alloy, the use thereof and a process for manufacturing the alloy.

2. Description of the Prior Art

Heretofore, for cast components for fixing magnet coils and also for highly stressed parts of electrical machines (e.g. single-phase rotary current generators) which may not cause any problems or constrictions of the magnetic flux, preferably austenitic spheroidal cast iron of the type GGG-NiMn 13 7 or GGG-NiMn 23 4 or austenitic cast steel according to basic pig iron specification 390 or ASTM A-296 CF 20 are used.

These alloys all have the disadvantage that the total set of properties required of such parts can not be met by any of these cast iron-carbon alloys, namely, deep permeability $\mu$ homogeneous strength and toughness values up to large wall thicknesses, structural stability at low temperatures to −196° C. and during changes in temperature, homogenous magnetic permeability in large solidification cross sections in the range of 100–500 mm even in the residual solidification zone, machinability and weldability which is at least as satisfactory as for the standard rustproof steel casting alloys, e.g. Material No. 4308 or 4408 (DIN 17 445), yield point or proof limit of at least 250 N/mm$^2$, weldable without micro-cracks.

Depending on the composition, high-alloy CrNiMn cast steel may be fully austenitic or, with an appropriate increase of the Cr content or reduction of the Ni and/or Mn content, may additionally contain more or less high portions of ferrite in the austenitic basic structure. The austenitic phase is non-magnetic, with a very low magnetic permeability ($\mu \leqq 1.001$), while the ferritic phase is ferromagnetic with correspondingly high permeability values. For this reason, in two-phase austenitic-ferritic alloy, the magnetic permeability strongly increases together with the ferrite content (FIG. 5). Therefore, for so-called non-magnetic alloys with very low permeability, exclusively fully austenitic alloys are used if these steels are to be used as wrought alloys. This course can not be taken in the case of cast steel, since the alloys cannot subsequently deformed. Due to their high susceptibility to heat cracks during welding, fully austenitic CrNiMo steel casting alloys are practically not weldable without cracking. This problem does not arise in the wrought alloys (forging steels and rolled steels) to such an extent since these steels are much stabler in respect to the susceptibility to heat cracks during welding as a result of the deformation and the consequently possible subsequent change in granulation of the structure through recrystallization by means of a heat treatment.

As is well known, the weldability of the cast CrNiMn steel alloys is improved significantly, when these alloys have certain ferrite contents. In this regard, it is not important how much ferrite these alloys have in the state of use, for example, at room temperature, but what ferrite contents they have during the welding state. During welding, i.e. in the state of equilibrium in the vicinity of the melting point, the ferrite content should be about 5%. Our tests have shown that these ferrite contents are already achieved during the welding of alloys when they contain only about 2% ferrite in the cast state at room temperature.

It is true that CrNiMn steel casting alloys with ferrite contents of more than 2% are known; however, they can not be used as non-magnetic, rustproof steel castings since the permeability is too high due to the ferrite content.

SUMMARY OF THE INVENTION

The invention is based on the object to avoid the above-mentioned disadvantages and to meet the above-recited set of properties. More particularly, a non-magnetizable steel casting alloy is to be provided which simultaneously is immune to weld cracking.

This object is met by the characterizing features of the main claim.

The alloy according to the invention can be advantageously used in components of nuclear fusion reactor plants where field intensities H of more than $10^3$ Oersted prevail, however, they can also be used at temperatures below −150° C.

It has been found that the reason for the strikingly more favorable behavior during the welding of the alloys in the presence of certain ferrite portions is to be found in the morphological peculiarities in respect to solidification of the alloying system FeCrNiMn. In the alloying range of up to 20% Cr, up to 15% Ni and up to 20% Mn, a peritectic melting interface separates the austenitic primary solidification from the ferritic primary solidification. Starting from the partially known ternary systems FeCrNi and FeCrMn and supported by alloying tests, the following relationship was found for the peritectic melting interface:

$$f = 6.5 - \%Cr - 0.4 \cdot \%Ni + 0.1 \cdot \%Mn + 0.075 \cdot \%Cr \cdot \%Ni + 0.013 \cdot \%Cr \cdot \%Mn - 0.02 \cdot \%Ni \cdot \%Mn$$

DESCRIPTION OF THE PREFERRED EMBODIMENT

Quaternary FeCrNiMn alloys with a CrNiMn equivalence factor $f > 2$ solidify primarily austenitically and, therefore, are fully austenitic at room temperature. Alloys with $f < 2$ solidify primarily ferritically. When the f values are not too low, the ferritic primary solidification is followed by a binary peritectic reaction. In the case of $f < 0$, the solidification of the alloys terminates with the peritectic reaction. In the case of alloys with $0 \leqq f \leqq 2$, an austenitic residual solidification, which also leads to fully austenitic products, takes place after the ferritic primary solidification and the binary peritectic reaction. The important peritectic reaction has the result that austenite is formed by dissolving the primary-formed ferrite, contrary to the primary austenitic or austenitic residual solidification, in each of these cases the austenite being formed from the melt without the participation of ferrite.

Figure 4:
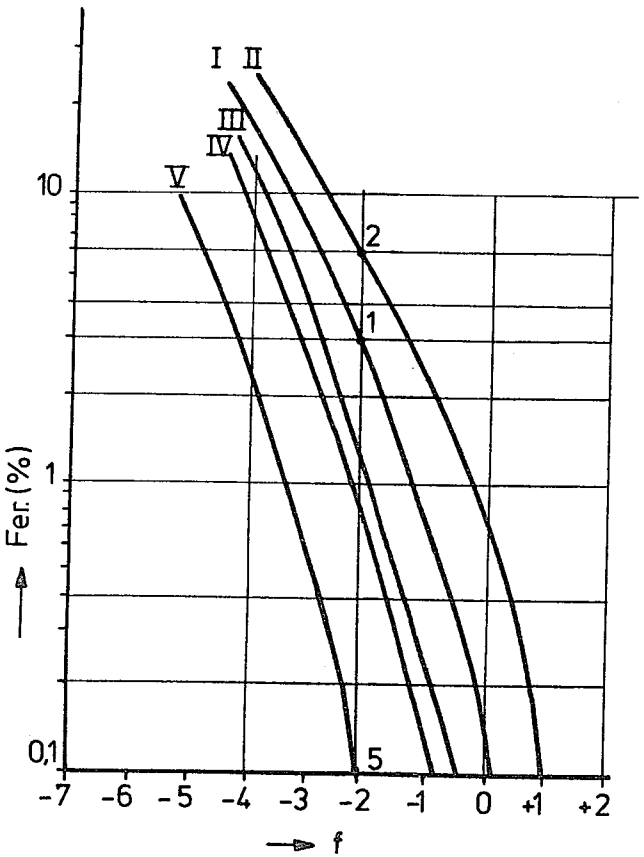
FIG. 4 is a graph showing the relationship between the CrNiMn equivalence factor and the ferrite content of alloys according to the present invention.

During welding which constitutes a remelting, the phase reactions take place in the reverse order. In fully austenitic products, in each of the two cases, i.e. for $f>2$, the grain boundaries formed by primary residual solidification are melted. In the range of the line of melting of the austenitic welding, this results in the dangerous heat cracks which practically exclude an absolute safe weldability. In the cases of $f \leqq 2$, in which the solidification concludes with the peritectic reaction, the phase boundaries ferrite/austenite will melt. From a morphological viewpoint, this is a completely different situation which has the result that heat cracks do not occur during welding. The knowledge of this situation makes possible the selection of those alloys which have just as much ferrite as necessary in respect to their weldability and as little as possible in respect to a low magnetic permeability. For this purpose, the alloying elements Cr, Ni and Mn which are important for the structure must be brought into the relationship defined above, resulting in a strict selection of the alloy. Since the CrNiMn steel casting alloys have the tendency to reach a state of imbalance during the cooling after the casting and welding, a subsequent heat treatment may become necessary in order to adjust the equilibrium which is imminent to the system. The effect of such a heat treatment in respect to a reduction of the ferrite content is shown in FIG. 4, which shall be explained in more detail hereinbelow.

The combined increase of the nitrogen and the manganese contents in the steel casting alloys according to the invention makes it possible to significantly raise the yield point, compared to conventional purely austenitic chrome nickel steels, without creating porosities due to nitrogen precipitation as they may occur in the case of a strong segregation in large casting cross sections due to insufficient nitrogen solubility.

The same effect could be achieved also by other elements, for example, by carbon or phosphorus.

However, it has been found that increasing carbon contents result in a deterioration of the machinability due to the increasing hardness of the martensite created by the cold forming during machining and that, on the other hand, increasing phosphorus contents negatively effect to a significant degree the toughness values even in the solution-treated state. The steel casting alloy according to the invention is preferably used with a carbon content of C 0.06% according to claim 2 in order to limit the carbide precipitations and to avoid an embrittlement, particularly during stress annealing. Additional advantages of the low carbon content reside in the better machinability and the protection against intercrystalline corrosion. The reduction in yield point caused by the lower carbon content is compensated by an increased nitrogen content. The immunity to cracks during welding is significantly increased if a S content according to claim 4 is chosen.

The contents of chromium and nickel in the steel casting alloy according to the invention depends on the operating temperature of the plant components. In the case of low operating temperatures, high chromium/-nickel contents should be chosen in order to insure the austenite stability.

In the following, an embodiment of the invention is explained wherein the compositions are always given in percent by weight.

EXAMPLE

A steel casting alloy according to the invention with the composition

| C | Mn | Si | P | S | Cr | Ni | Mo | $N_2$ |
|---|---|---|---|---|---|---|---|---|
| 0.044 | 11.6 | 0.74 | 0.028 | 0.010 | 15.7 | 8.72 | 0.05 | 0.155% |

the remainder being iron with the usual accompanying elements and impurities resulting in cast structural componentlike samples with a wall thickness of 200 mm, in the following mechanical properties:

| | |
|---|---|
| Yield point | Rp 0.2 281 N/mm$^2$ |
| Max. tensile strength | Rm 466 N/mm$^2$ |
| Elongation at rupture | $A_5$ 39% |
| Necking | Z 47% |
| Notched bar impact work | $K_{CV}$ 178 Joule |
| Brinell hardness | HB 159 |

wherein the equivalence factor f was −0.916.

On the otherhand, a conventional austenitic cast steel pursuant to ASTM A-296 CF 20 of the composition

| C | Mn | Si | P | S | Cr | Ni | Mo | $N_2$ |
|---|---|---|---|---|---|---|---|---|
| 0.17 | 1.16 | 0.82 | 0.009 | 0.010 | 19.7 | 8.62 | 0.04 | 0.060% |

the remainder being iron, accompanying elements and impurities, resulted in a lower yield point and notched bar impact work. The machinability of the steel casting alloy according to the invention is also superior to that of CF 20 or other comparable iron-carbon steel casting alloys. Moreover, CF 20 is not weldable without microcracks.

Figure 1:
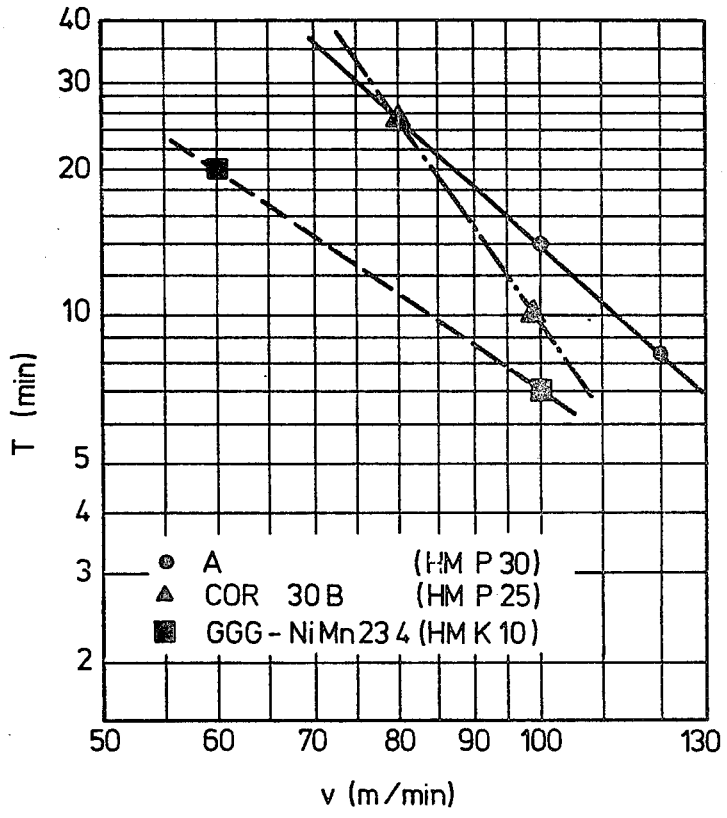
FIG. 1 is a graphical comparison of the tool life of alloys within and without the scope of the invention.

It is referred to FIGS. 1 to 4. FIG. 1 illustrates the graphical comparison between the alloy A according to the invention (solid circles) and the other alloys (solid triangles and squares) in the case of turning. The cutting speed V (m/min.) is plotted on the abscissa and the total life T VB 0.4 (min) is plotted on the ordinate.

Figure 2:
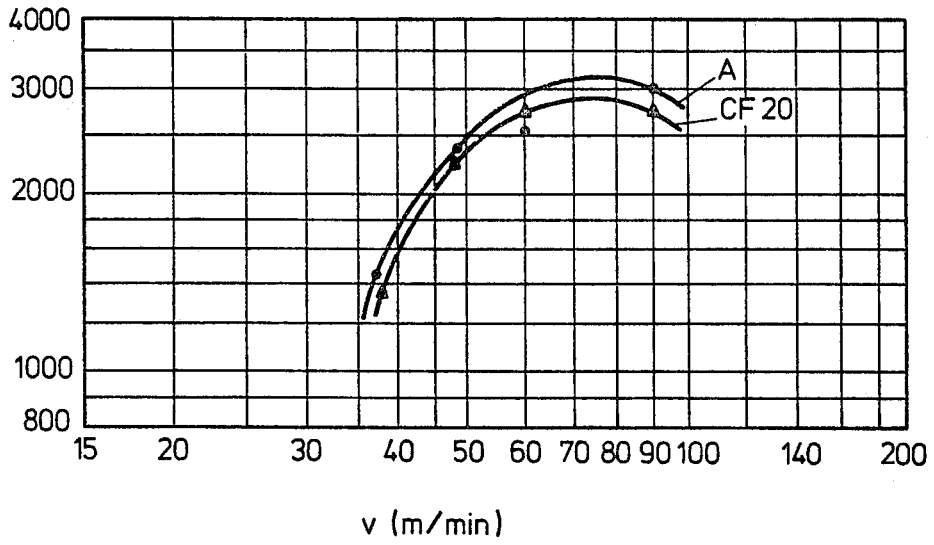
FIG. 2 is a graph similar to FIG. 1 except relating to miling cutting.

FIG. 2 relates to milling cutting. The cutting material is Widia TT 40. The plate dimension is TNAF 2504 ZZR. The feed is $s_z=0.11$ mm/tooth and no cooling was performed. The cutting speed V (m/min) is plotted on the abscissa and the endurance L (mm/tooth) is plotted on the ordinate.

Figure 3:
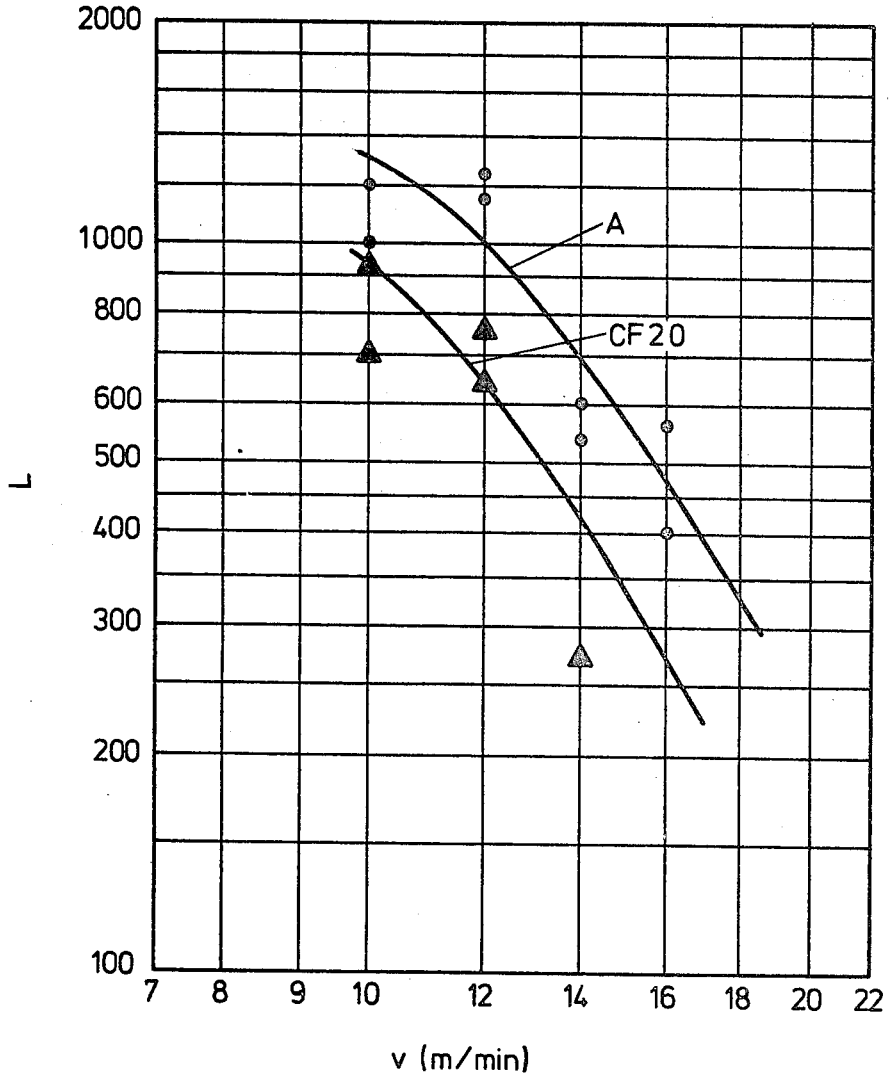
FIG. 3 is a graph similar to FIG. 1 except relating to drilling.

FIG. 3 relates to the comparisons in the case of drilling. The work material is CF 20. The tool is a HSS twist drill with a diameter of 5 mm. The feed is $s=0.06$ mm/rot. Cooling was performed by means of an oil emulsion. The cutting speed V (m/min) is plotted on the abscissa and the endurance L (mm) is plotted on the ordinate.

FIG. 4 shows the relationship between the CrNiMn equivalence factor f of the alloys according to the invention on the abscissa and the ferrite content (Fer) in % on the ordinate, wherein

| | | | |
|---|---|---|---|
| the curve | I | shows the condition after | casting, |
| the curve | II | shows the condition after | welding, |
| the curve | III | shows the condition after | annealing at 1100° C. |
| the curve | IV | shows the condition after | annealing at 850° C. |

-continued

| | | | | |
|---|---|---|---|---|
| the curve | V shows the condition after | annealing at | 650° C. | |

The region of the ferritic primary solidification is to the left of the vertical axis through f=2 and the region of the austenitic primary solidification is to the right of this axis.

Figure 5:
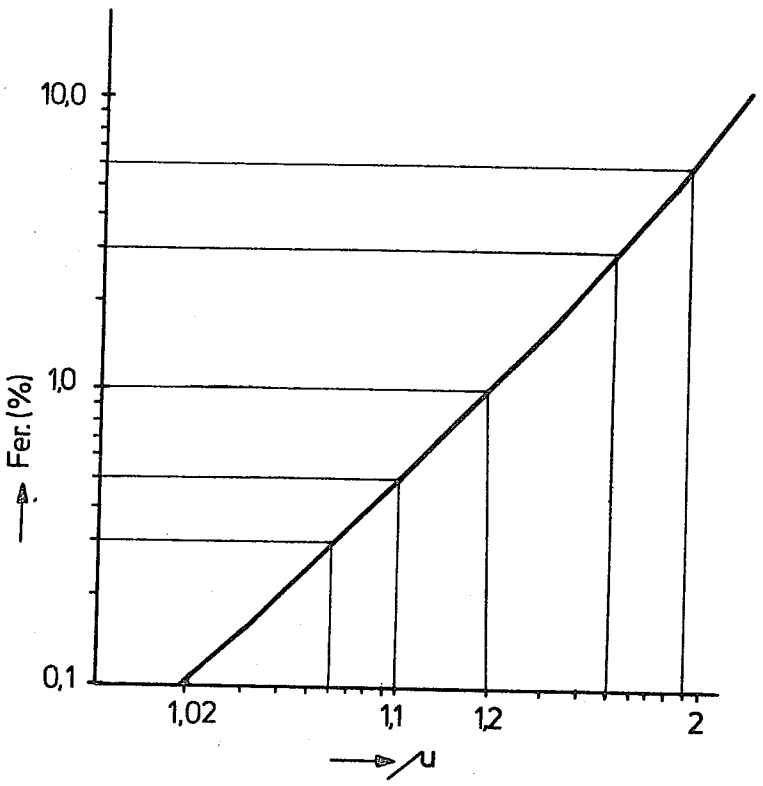
FIG. 5 is a graph showing the relationship between the permeability and the ferrite content of alloys in accordance with the present invention.

FIG. 5 shows the relationship between the permeability $\mu$ which is plotted on the abszissa and the ferrite content Fer in % which is plotted on the ordinate.

A preferred embodiment of the alloy results from Claim 3. In this claim, the factor f=−2 was chosen. After solidification, point 1 on curve I of FIG. 4, the ferrite content is 3%. During welding, point 2 on curve II, the ferrite content increases to 6%. By an annealing treatment, point 5 on the point of intersection of the abscissa and the curve V, the ferrite content can be reduced to 0.1% which corresponds to a $\mu$ value of 1.02. If necessary, this $\mu$ value can be further reduced by an appropriate heat treatment.

The favorable magnetic permeability of the steel casting alloy according to the invention is maintained also in structural components of large cross sections in the range of 100–500 mm, preferably 200–300 mm, even in the residual solidification zone, because a high austenitic stability and a high homogeneity of the properties is achieved even with modest alloying expenses. Especially in the case of extremely strong magnetic fields of, for example, $10^3$ Oersted field intensity, as they are required in fusion reactors for the shaping of the plasma, the alloy according to the invention provides significant advantages over the conventional alloys.

The measurement of the magnetic permeability of the steel casting alloy according to the example was performed by means of the magnetoscope of the Type 1.067 (Institute Dr. Förster) and resulted in the following values for a test specimen of the dimensions 200×200×300 mm (about 250 $\mu$m peak-to-valley height) over the cross section of 300 mm:

| | $\mu$(G/Oe) | | | | | |
|---|---|---|---|---|---|---|
| Treatment | 10 | 50 | 100 | 150 | 200 | 240 mm |
| 1100° C./10h/$H_2O$ | 1.011 | 1.017 | 1.013 | 1.011 | 1.019 | 1.013 |

Especially advantageous steel casting alloys, for example, have the composition in percent by weight

| C | Mn | Si | Cr | Ni | N |
|---|---|---|---|---|---|
| max. 0.06 | 9–11 | max. 1.0 | 14–16 | 7.0–8.0 | 0.10–0.15 |

the remainder being iron and possibly accompanying elements and impurities, and the composition in percent by weight

| C | Mn | Si | Cr | Ni | N |
|---|---|---|---|---|---|
| max. 0.06 | 10–12 | max. 1.0 | 18–20 | 8.0–9.5 | 0.1–0.2 |

the remainder being iron and possibly accompanying elements and impurities. The equivalence factors are f=−1.61 and f=−1.635, respectively.

We claim:

1. A non-magnetizable steel alloy cast in its final form having the composition

| | |
|---|---|
| C | max. 0.30% |
| Si | max. 2.00% |
| Mn | 4.00–20.00% |
| Cr | 10.00–20.00% |
| Ni | 4.00–12.00% |
| Mo | max. 3.00% |
| $N_2$ | 0.02–0.20% |

with the remainder being iron, having magnetic permeability $\mu \leqq 1.20$, in large solidification cross sections in the range of 100 to 500 mm in the residual solidification zone, a CrNiMn equivalence factor: $f=6.5-\%Cr-0.4\cdot\%Ni+0.1$ wt.%Mn $+0.075$ wt.%Cr·%Ni$+0.013\cdot\%Cr\cdot\%Mn-0.02\cdot\%Ni\cdot\%Mn$, wherein f is between −2.5 and −1.5.

2. The alloy of claim 1 having the composition:

| | |
|---|---|
| C | max. 0.06% |
| Si | max. 1.00% |
| Mn | 9.00–12.00% |
| Cr | 14.00–20.00% |
| Ni | 7.00–10.00% |
| $N_2$ | 0.1–0.2% |
| Mo | max. 1.50%. |

3. The alloy of claim 1 or 2 wherein the sulfur content is a max. of 0.02%.

4. A plant component for a nuclear fusion reactor plant, which component is non-magnetizable when subjected to an electromagnetic field intensity H of about $10^3$ Oersted and operating temperatures of less than −150° C., formed from the alloy of claim 1.

* * * * *